US006484460B2

(12) United States Patent
VanHaitsma

(10) Patent No.: US 6,484,460 B2
(45) Date of Patent: Nov. 26, 2002

(54) STEEL BASEMENT WALL SYSTEM

(76) Inventor: Steve J. VanHaitsma, 3411 Ottogon, Hudsonville, MI (US) 49426

( * ) Notice: Subject to any disclaimer, the term of this patent is extended or adjusted under 35 U.S.C. 154(b) by 0 days.

(21) Appl. No.: 09/767,051

(22) Filed: Jan. 22, 2001

(65) Prior Publication Data

US 2001/0004818 A1 Jun. 28, 2001

Related U.S. Application Data

(63) Continuation-in-part of application No. 09/033,736, filed on Mar. 3, 1998.

(51) Int. Cl.[7] ..... E02D 27/00; E04C 2/34

(52) U.S. Cl. ..... 52/293.1; 52/164.14; 52/274; 52/243.3; 52/481.1

(58) Field of Search ..... 52/169.14, 169.12, 52/274, 293.3, 293.1, 461.1, 483.1

(56) References Cited

U.S. PATENT DOCUMENTS

| | | | | | |
|---|---|---|---|---|---|
| 791,775 | A | | 6/1905 | Hansell | |
| 1,062,091 | A | | 5/1913 | Foster | |
| 1,995,514 | A | | 3/1935 | Martin | |
| 2,017,106 | A | | 10/1935 | Sandell | |
| 2,101,090 | A | | 12/1937 | Palmer | |
| 2,143,288 | A | * | 1/1939 | Stolz | 52/293.1 |
| 2,249,799 | A | | 7/1941 | Trainer | |
| 2,433,652 | A | | 12/1947 | Crom | |
| 2,743,602 | A | | 5/1956 | Dunn | |
| 3,262,236 | A | * | 7/1966 | Poyer | 52/58 |
| 3,323,268 | A | | 6/1967 | Johnson | |
| 3,859,766 | A | | 1/1975 | Flotow et al. | |
| 4,078,347 | A | | 3/1978 | Eastman et al. | |
| 4,221,087 | A | * | 9/1980 | Lowe | 52/91.3 |
| 4,222,208 | A | | 9/1980 | Ferver | |
| 4,235,054 | A | | 11/1980 | Cable et al. | |
| 4,263,762 | A | | 4/1981 | Reed | |
| 4,310,992 | A | | 1/1982 | Thabet | |
| 4,364,213 | A | | 12/1982 | Biesanz, Sr. | |
| 4,368,604 | A | | 1/1983 | Spielau et al. | |
| 4,435,934 | A | | 3/1984 | Kim | |
| 4,559,748 | A | | 12/1985 | Ressel | |
| 4,757,651 | A | | 7/1988 | Crites | |
| 4,776,138 | A | | 10/1988 | Sumner et al. | |
| 4,805,364 | A | | 2/1989 | Smolik | |
| 4,962,622 | A | | 10/1990 | Albrecht et al. | |
| 5,165,210 | A | | 11/1992 | Partyka et al. | |
| 5,218,803 | A | * | 6/1993 | Wright | 52/243 |
| 5,373,674 | A | | 12/1994 | Winter, IV | |
| 5,398,471 | A | | 3/1995 | Spagnolo | |
| 5,402,612 | A | * | 4/1995 | DiGirolamo et al. | 52/241 |
| 5,425,207 | A | | 6/1995 | Shayman | |
| 5,535,556 | A | | 7/1996 | Hughes, Jr. | |
| 5,551,204 | A | | 9/1996 | Mayrand | |
| 5,592,796 | A | | 1/1997 | Landers | |
| 5,653,082 | A | | 8/1997 | Shinoda et al. | |
| 5,657,606 | A | | 8/1997 | Ressel et al. | |
| 5,718,092 | A | | 2/1998 | Corston | |
| 5,732,520 | A | | 3/1998 | Maietta | |
| 6,279,289 | B1 | * | 8/2001 | Soder et al. | 52/656.9 |
| 6,354,050 | B1 | * | 3/2002 | Pankoski | 52/126.6 |

* cited by examiner

*Primary Examiner*—Carl D. Friedman
*Assistant Examiner*—Brian E. Glessner
(74) *Attorney, Agent, or Firm*—Price, Heneveld, Cooper, DeWitt & Litton

(57) ABSTRACT

A highly economical basement wall providing strength and comfort comparable to conventional basement wall structures includes a metal sill, a plurality of spaced apart metal wall studs, a metal decking secured to the plurality of metal wall studs, and a metal reinforcing stud welded to the plurality of metal wall studs. Each of the reinforcing studs is also welded to the sill and extends upwardly from the sill to a height of about 25% or less of the height of the metal wall studs.

5 Claims, 2 Drawing Sheets

STEEL BASEMENT WALL SYSTEM

CROSS-REFERENCE TO RELATED APPLICATION

This application is a Continuation-in-part of application Ser. No. 09/033,736, filed Mar. 3, 1998, the entire content of which is hereby incorporated by reference into this application.

FIELD OF THE INVENTION

This invention relates to habitable basements, and more particularly to a basement wall system that facilitates rapid construction at a low cost.

BACKGROUND OF THE INVENTION

Basement walls for residential buildings have generally been constructed of concrete. Typically, spaced apart vertical forms are assembled at a building site, and concrete is poured into the space defined between the forms. After the concrete has been poured, it must be allowed to set or cure for a period of several days, and often as much as two weeks or even longer. Construction of a building having a poured concrete wall must be completely suspended during the time which the concrete is curing. This delay in construction is undesirable because it usually results in a delay in progress payments and/or final payment to the builder, and can often be associated with reduced profits and/or higher costs.

Another disadvantage with concrete basement walls is that they have relatively high capacity for absorbing and conveying moisture through capillary action, and, as a result, basements with concrete walls tend to be damp and clammy. This problem cannot be completely overcome by providing the concrete wall with a water-resistant barrier coating or layer because moisture can still be transported from the ground through the footing, and into, and through, the concrete walls.

A further disadvantage with concrete basement walls is that they have relatively low thermal insulating properties. As a result, conventional basements having concrete walls tend to be relatively cool and generally uncomfortable during the winter months.

The above referenced application (Ser. No. 09/033,736) upon which priority is claimed in this application discloses an improved basement wall system that overcomes many of the problems with the prior art, and allows rapid construction of a highly moisture resistant, comfortable basement, that in most cases can be constructed at a substantially reduced cost as compared with many conventional habitable basement structures. Although the disclosed basement wall system provides many advantages over conventional basement wall structures, it has now been discovered that the same advantages can be achieved with an improved structure that further reduces construction costs.

SUMMARY OF THE INVENTION

In one aspect of the invention, there is provided a highly economical basement wall structure that can be utilized to define a habitable basement that provides strength and comfort that equals or exceeds that of conventional basement wall structures. The basement wall in accordance with this aspect of the invention includes a metal sill, a plurality of spaced apart metal wall studs, metal decking secured to the plurality of metal wall studs, and a metal reinforcing stud welded to each of the plurality of metal wall studs. The wall studs extend upwardly from the sill to a height of the habitable basement, and the reinforcing studs extend upwardly from the sill to a height of about 25% or less of the height of the wall studs.

In accordance with another aspect of the invention, a habitable building basement that meets or exceeds applicable construction standards in most or all localities is provided. The habitable building basement includes a concrete basement floor and a basement wall extending upwardly from the basement floor, wherein the basement wall and basement floor define a habitable basement. The basement wall includes a metal sill, a plurality of metal wall studs welded to the sill and extending upwardly from the sill to a height of the habitable basement, metal decking secured to the plurality of metal studs, and a metal reinforcing stud welded to each of the plurality of metal wall studs. Each of the reinforcing studs is also welded to the sill and extends upwardly from the sill to a height of about 25% or less of the height of the metal wall studs.

These and other features, advantages and objects of the present invention will be further understood and appreciated by those skilled in the art by reference to the following specification, claims and appended drawings.

DETAILED DESCRIPTION OF PREFERRED EMBODIMENTS

Figure 1:
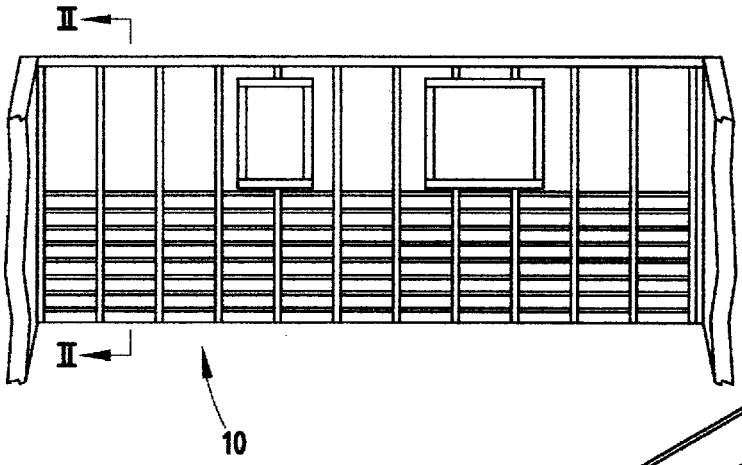
FIG. 1 is a perspective view of a basement wall of a building constructed in accordance with the principals of this invention.
Figure 2:
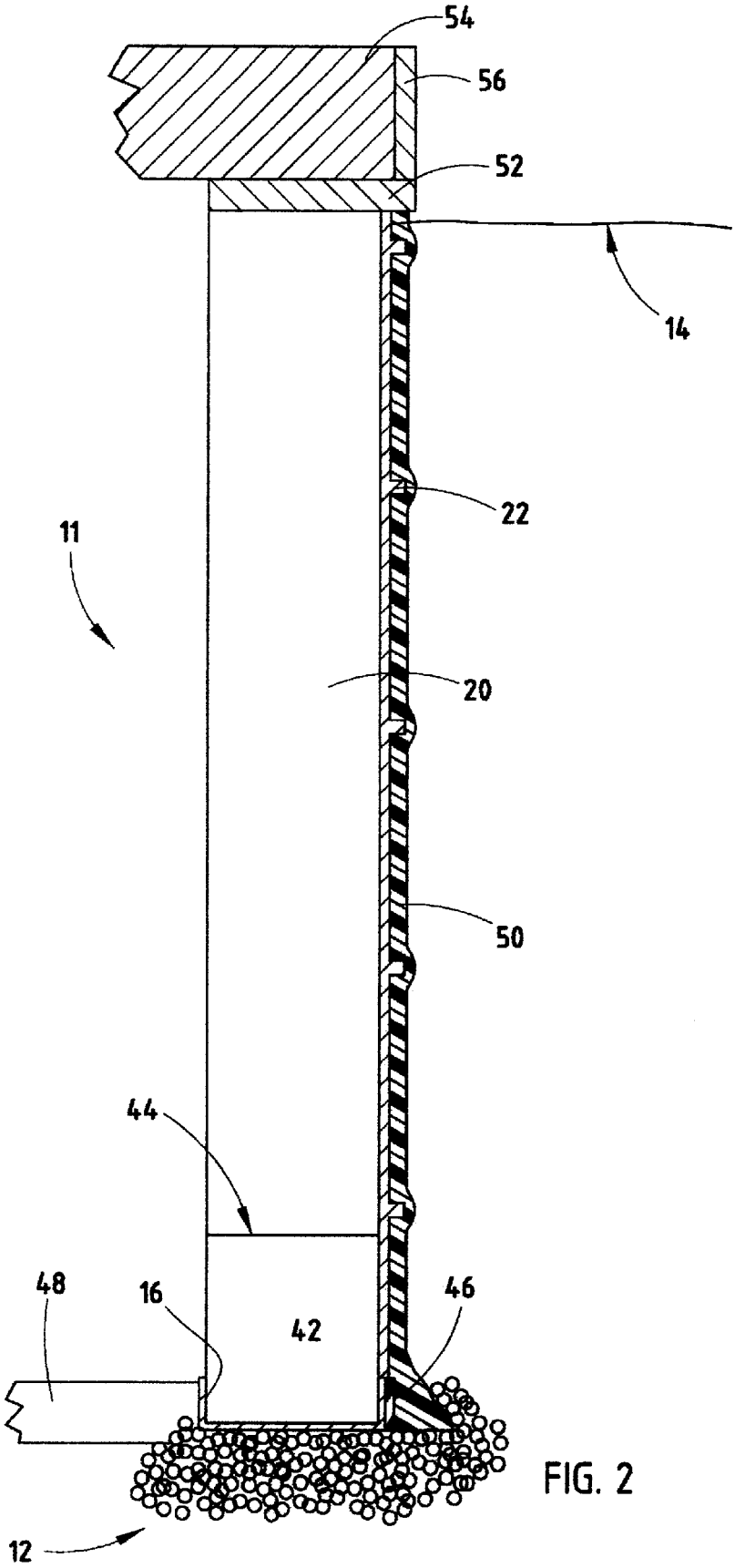
FIG. 2 is an elevational view, in partial cross section, of the basement wall shown in FIG. 1, as viewed along lines II—II.

A basement wall construction 10 in accordance with the principles of this invention is shown in FIG. 1. A full basement wall 11 is shown in FIG. 2 erected on a footing 12 within an excavation, i.e., below ground level 14. Footing 12 is comprised of compacted pea stones (i.e., stones having a size about equal to or smaller than the size of peas), but can be a conventional concrete footing if desired. The wall 11 may be transported to a construction site and erected in preassembled sections, such as in 10 to 40 foot long sections which can be easily transported such as on a conventional flat bed trailer.

Figure 3:
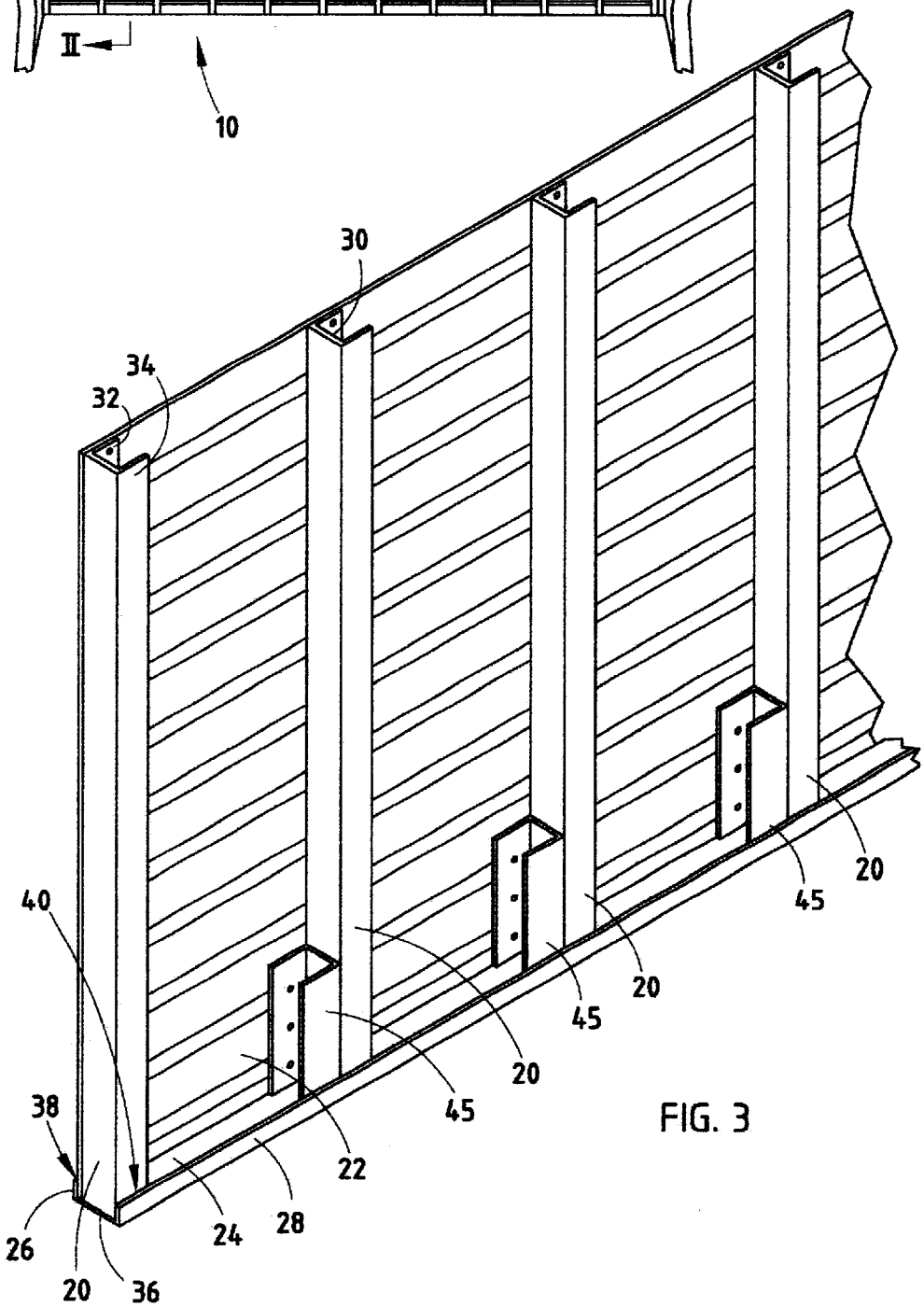
FIG. 3 is a perspective view of a prefabricated section of a basement wall in accordance with the principles of this invention.

As shown in FIG. 3, the prefabricated sections include a metal sill or base 16, a plurality of vertical wall studs or columns 20, and metal decking 22. Sill 16 has a U-shape channel configuration defining a horizontal base portion 24, an outside vertical flange portion 26, and an inside vertical flange portion 28. Vertical studs 20 are configured to include a web portion 30 which extends along a vertical plane transverse to the length of the basement wall, an outside flange 32 which extends along a plane transverse to the plane of the web, and an inside flange 34 which extends along a plane transverse to the plane of the web. The thickness of studs 20, as measured from the outwardly facing of side of flange 32 to the inwardly facing side of flange 34, is approximately equal to the distance between the inwardly facing side outside flange portion 26 and the outwardly facing side of inside flange portion 28 of sill 16, wherein by the lower ends of studs 20 fit snuggly between the flange portions of sill 16.

Wall studs 20 are fixed to sill 16 by welding, such as along a lower edge 36 of web 30 that abuts against base portion 24 of sill 16, and/or at the upper edges 38, 40 of flange portions 26, 28 which abut against the outwardly facing side of flange 32 and the inwardly facing side of flange 34 of studs 20 respectively. Metal decking 22 is secured to studs 30, preferably with fasteners, such as screw fasteners or rivets. As another alternative, metal-decking 22 may be welded to studs 30.

As disclosed in the above referenced application (Ser. No. 09/033,736) to which this application claims priority, a basement wall structure having strength and weather proofing characteristics equal to or exceeding those of conventional basement structures, but having advantages in terms of decreased construction time and expenses, can be achieved with a wall structure that consists essentially of a sill, spaced apart studs, and metal decking affixed to the studs. However, in order to withstand the lateral loads imposed upon the basement wall when the earth adjacent the outside of the wall is back filled to an elevation equal to or nearly equal to the full depth of the basement, relatively heavy gauge studs must be employed. For example, for a typical residential application having studs spaced approximately 16 inches apart, a suitable channel-shaped stud for fabricating the basement wall is a 14 gauge galvanized steel stud having a current cost of about one dollar per linear foot. It has now been discovered that the cost of fabricating and erecting the basement wall can be substantially reduced by utilizing a lighter gauge stud in combination with a relatively short metal reinforcing stud affixed to the full height wall studs 20. For example, a load bearing strength comparable to that achieved with a 14 gauge stud can be achieved by employing 18 gauge studs spaced apart by the same distance as the 14 gauge studs, but wherein the 18 gauge studs are reinforced with a relatively short 18 gauge stud. Each metal reinforcing stud 45 is welded to one of the metal wall studs 20, and each reinforcing stud 45 is also welded to sill 16. Studs 45 extend upwardly from sill 16 to a height of about 25% or less of the height of metal wall studs 20, and more preferably to a height of about 10% or less of the height of metal wall studs 20. For example, for an 8 foot high basement, metal wall studs 20 have a height of about 8 feet, and a suitable height for metal reinforcing stud 45 is about 2 feet or less, with a reinforcing stud height of 10 inches (i.e., about 10% of the height of wall studs 20) being acceptable. Reinforcing studs having a height greater than 25% of the height of wall studs 20 may be used. However, heights greater than 25% of the height of the wall studs 20 are unnecessary and do not provide desirable economic advantage. Reinforcing stud heights below 10% of the height of the wall studs 20 may also be used. However, in order to achieve the required load bearing properties heavier gauge studs 20 and 45 are needed when reinforcing studs 45 have a height considerably less than about 10% of the height of wall studs 20, thereby reducing or eliminating any economic advantage in using the reinforcing studs 45.

The economic advantages of the invention are illustrated by the following example. Using 120 eight foot long, 14 gauge studs for a typical residential building having about 160 linear feet of basement wall requires about 960 feet of metal channel at a current cost of about one dollar per linear foot. Therefore, the total cost of the wall studs for the basement would be about $960 when the reinforcing studs of this invention are not employed. However, a comparable load bearing capacity can be achieved with about 1080 feet (120 eight foot wall studs 20 and 120 one foot reinforcing studs 45) of an 18 gauge metal channel at a current cost of about 65 cents per linear foot. The total cost for the metal channel needed for the wall studs 20 and reinforcing studs 45 in accordance with the invention is about $702. Thus, for the illustrated example, the improved basement wall system of the invention provides a savings of about $258.

Although it is envisioned that a typical basement wall in accordance with this invention would employ one reinforcing stud 45 for each wall stud 20, the advantages of this invention can also be achieved without providing every wall stud 20 with a reinforcing stud 45. The requirement that a metal reinforcing stud be welded to each of the plurality of metal wall studs does not mean that every wall stud used in a basement wall construction in accordance with this invention be provided with a reinforcing stud. A basement wall may be built in accordance with the principles of this invention employing a first plurality of spaced apart metal wall studs that do not have a reinforcing stud welded thereto, and a second plurality of spaced apart metal wall studs having reinforcing studs welded thereto. For example, it is conceivable that the benefits of this invention can be realized in a structure in which, for example, alternating wall studs 20 are provided with a reinforcing stud 45.

Sill 16, studs 20 and 45, and decking 22 are preferably made of high grade galvanized steel, although other materials having suitable structural integrity and corrosion resistance may be employed. It is also desirable to coat, such as by spraying, all wells with a rust inhibitor. Because the lower portions of the basement wall are somewhat more likely to come in contact with water, the lower portions of the prefabricated sections (as shown in FIG. 3) are preferably provided with a water-resistant coating. For example, after a section, such as shown in FIG. 3, is assembled, it may be dipped into a liquid asphalt solution that coats, for example, the bottom six inches of the preassembled wall section. The liquid asphalt solution will dry into a high-gloss, water-resistant shell or coating 42 (FIG. 2) that covers and seals sill 16 and the lower portion of studs 20 and 45 to prevent moisture from contacting the metal surfaces of sill 16 and the lower portions of studs 20 and 45.

The prefabricated wall sections as described above are transported to a construction site and position on a suitable footing 21, with the ends of each wall section abutting an adjacent wall section to form a continuous basement wall. The ends of adjacent sills 16 of adjacent wall sections are preferably connected together. This can be achieved, for example, by welding the abutting edges of adjacent sills 16 along the base portions 24 and/or along the flange portions 26, 28. Alternatively, it is possible to connect the sills 16 of adjacent wall sections by welding or otherwise fastening a suitable metal strap to portions of the adjacent sills, such as with screws or rivets.

In order to enhance the water resistance of the basement walls, and particularly to prevent or inhibit water leakage between the lower portion of the basement walls and the concrete floor of the basement, the sill 16 is preferably wrapped in a waterproof membrane 46 which extends continuously along the outwardly facing side of flange portion 26, the underside of base portion 24 and the inwardly facing side of flange portion 28. The waterproof membrane gives the wall a waterproof bottom surface and a side surface to bond with a foam membrane 50. Suitable waterproof membranes include elastomeric membranes, such as those comprised of natural or synthetic rubber. The thickness of the waterproof membrane is not particularly critical. However, a suitable thickness for waterproof membrane 46 is, for example, 60 mils.

In many, if not most, cases it may be necessary to brace the walls over the footing until the concrete floor 48 of the basement is poured. Once the concrete floor 48 has been poured, and has set, the basement walls become locked in place, and the bracing, if any, may be removed.

As illustrated in FIG. 2, basement wall 10 is provided with an exterior polymeric foam coating 50. The polymeric foam layer 50 is suitably applied in liquid form and expands after it is applied to the outwardly facing surface of decking 22. Desirably, the foam is applied after the basement wall sections have been abuttingly positioned on footing 12 to provide a seamless membrane or layer around the foundation that both chemically and mechanically bonds to the steel and footing. A suitable foam material which may be applied in liquid form and which expands up to 30 times after it is applied to the outwardly facing side of decking 22 is sold by Foam Enterprises, Inc., Minneapolis, Minn., under the product designation "FE 303-02.0 HC". The FE 303-2.0 HC spray foam when applied to achieve a final foam thickness of approximately 1 inch provides a basement wall has an insulation rating of R-7. Additionally, if desired, the space between the studs 20 on the interior side of decking 22 may be filled with additional insulation, such as additional foam insulation or glass fiber batt.

Generally, within one day after the wall sections comprising sills 16, studs 20 and metal decking 22 have been erected on site and concrete floor 48 has been poured, it is possible to begin framing, e.g., installing wood sill plate 52, floor joists 54, and rim joist 56.

For full basement walls (those in which most or nearly all of the basement wall is below ground level), suitable thicknesses (distance from the outwardly facing side of flange 32 to the inwardly facing side of flange 34) include 6 and 8 inches, with 8 inch studs being preferred for larger residential buildings or buildings having 9 foot basements, and with the 6 inch walls being preferred for smaller residential buildings. For the full basement walls, the studs are generally spaced apart by approximately 16 inches, although larger or smaller spacings can be used.

In the illustrated embodiments, installation of the basement wall system of this invention has been described with reference to erecting the basement wall system on a pea stone footing. However, a concrete footing can be used as well. In the case where a concrete footing is used, it may be desirable to eliminate the water-resistant membrane 46, and instead position an asphalt impregnated fibrous mat (such as 30# felt paper) between the concrete footing and the underside of sill 16.

Although installation of the basement wall of the present invention has been described primarily with reference to the use of prefabricated wall sections which are transported to and erected at a construction site, it is of course possible to install sill 16 onto a footing and construct the wall on-site to achieve many of the advantages described herein, without departing from certain principle aspects of the invention.

In addition to being ready for framing the day after installation and thereby facilitating rapid construction, and providing an insulting rating of R-12, the basement walls of the invention meet the Federal Energy Star Program. Further, only limited interior basement framing is needed, also allowing quicker construction. The resulting basement defined by the basement walls of this invention provides a living room quality environment, with no ugly, half-concrete walls showing in daylight rooms. The basement walls of the invention also provide dry multi-use areas, and because the metal wall structure does not absorb or transport moisture like concrete, and includes an exterior water-resistant, insulative layer, there is no damp, clammy feel. Another advantage with the basement walls of this invention is that the completed cost is approximately 25% less than the cost of concrete basement walls.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. A basement wall for a building, comprising:

a metal sill;

a plurality of spaced apart metal wall studs welded to the sill and extending upwardly from the sill to a height of about eight feet or more;

metal decking secured to the plurality of metal wall studs; and a metal reinforcing stud welded to each of the plurality of metal wall studs, each reinforcing stud also welded to the sill and extending upwardly from the sill to a height of about two feet or less.

2. A basement wall defining a habitable basement of a building, comprising:

a metal sill;

a plurality of spaced apart metal wall studs welded to the sill and extending upwardly from the sill to a height of the habitable basement;

metal decking secured to the plurality of metal wall studs; and a metal reinforcing stud welded to each of the plurality of metal wall studs, each reinforcing stud also welded to the sill and extending upwardly from the sill to a height of about 25% or less of the height of the metal wall studs.

3. The basement wall of claim 2, wherein the metal reinforcing studs extend upwardly from the sill to a height of about 10% or less of the height of the metal wall studs.

4. A habitable building basement, comprising:

a concrete basement floor; and a basement wall extending upwardly from the basement floor, the basement wall and basement floor together defining a habitable basement, the basement wall including:

(a) a metal sill, (b) a plurality of metal wall studs welded to the sill and extending upwardly from the sill to a height of the habitable basement, (c) metal decking secured to the plurality of metal wall studs; and (d) a metal reinforcing stud welded to each of the plurality of metal wall studs, each reinforcing stud also welded to the sill and extending upwardly from the sill to a height of about 25% or less of the height of the metal wall studs.

5. The habitable building basement of claim 4, wherein the metal reinforcing studs extend upwardly from the sill to a height of about 10% or less of the height of the metal wall studs.

* * * * *